US007895700B2

(12) United States Patent
Tanaka

(10) Patent No.: US 7,895,700 B2
(45) Date of Patent: Mar. 1, 2011

(54) CLEANING DEVICE

(75) Inventor: Yoshinori Tanaka, Kagawa (JP)

(73) Assignee: Uni-Charm Corporation, Shikokuchuo-shi (JP)

( * ) Notice: Subject to any disclaimer, the term of this patent is extended or adjusted under 35 U.S.C. 154(b) by 1667 days.

(21) Appl. No.: 11/123,764

(22) Filed: May 9, 2005

(65) Prior Publication Data

US 2005/0268423 A1 Dec. 8, 2005

(30) Foreign Application Priority Data

Jun. 3, 2004 (JP) ..... 2004-166291

(51) Int. Cl.
*A47L 13/10* (2006.01)

(52) U.S. Cl. ..... 15/231; 15/228; 15/209.1; 15/229.6; 15/224

(58) Field of Classification Search ..... 15/228, 15/231, 209.1, 229.6, 224
See application file for complete search history.

(56) References Cited

U.S. PATENT DOCUMENTS

| | | | | |
|---|---|---|---|---|
| 3,465,377 | A * | 9/1969 | Thomas | 15/147.1 |
| 4,349,933 | A | 9/1982 | Thompson | |
| 7,607,192 | B2 * | 10/2009 | Flora et al. | 15/231 |
| 2003/0074756 | A1 | 4/2003 | Policicchio et al. | |
| 2006/0016037 | A1 * | 1/2006 | Flora et al. | 15/228 |
| 2006/0048327 | A1 * | 3/2006 | Lacotta et al. | 15/228 |

FOREIGN PATENT DOCUMENTS

| | | |
|---|---|---|
| EP | 0 988 823 | 3/2000 |
| JP | 04-114620 | 4/1992 |
| JP | 05-305049 | 11/1993 |
| JP | 06-311954 | 11/1994 |
| JP | 11-244210 | 9/1999 |
| JP | 2004-033530 | 2/2004 |
| WO | 98/11812 | 3/1998 |
| WO | 98/23199 | 6/1998 |
| WO | WO-01/62132 | 8/2001 |

OTHER PUBLICATIONS

European Search Report mailed Mar. 31, 2008, directed to counterpart EP application No. EP 05252783.5; 3 pages.

* cited by examiner

*Primary Examiner*—Shay L Karls
(74) *Attorney, Agent, or Firm*—Morrison & Foerster LLP

(57) ABSTRACT

Disclosed is a cleaning device having a cleaning head to which a cleaning sheet is to be attached. The cleaning head has a pad whose bottom face functions as a cleaning part. The cleaning part has a recess, side contact parts on both sides of the recess and a rear contact part behind the recess. When a front portion of the cleaning head is pressed against a floor surface by a pushing force acting on the shaft, the recess prevents excessive frictional resistance. In addition, the cleaning sheet can be efficiently exploited because dirt can be collected also in the center of the cleaning part.

5 Claims, 5 Drawing Sheets

CLEANING DEVICE

BACKGROUND OF THE INVENTION

1. Field of the Invention

The present invention relates to a cleaning device suitable for cleaning a floor surface of a house, an office, etc., and more particularly to a cleaning device which can be stably slid on an object to be cleaned, such as a floor surface, to improve its cleaning ability.

2. Description of the Related Art

Cleaning devices to be used with a replaceable or disposable cleaning sheet are typically constructed to include a cleaning head, to which the cleaning sheet is to be attached, and a shaft-like handle whose front end is connected to the cleaning head.

In such cleaning devices, if the cleaning head has a flat bottom face, the cleaning sheet attached to the cleaning head will be applied to a surface to be cleaned (e.g., floor surface) with the flat bottom face in face-to-face relationship with the floor surface. When the floor surface is wiped off, dirt or dust will attach to the exterior surface of the cleaning sheet not centrally of the bottom face but around the front and rear edges of the bottom face. Therefore, the cleaning sheet cannot be fully exploited.

On the other hand, cleaning devices whose cleaning head has an uneven bottom face are disclosed in the following patent publications.

Japanese Patent Registration No. 2930472 discloses a cleaning head which has slopes along the front and rear ends of the bottom face to project toward the floor surface midway between the front and rear ends of the bottom face. Japanese Patent Registration No. 2981110 discloses a cleaning head which increases stepwise in thickness with distance from the front and rear ends of the bottom face to project toward the floor surface midway between the front and rear ends of the bottom face. Japanese Unexamined Patent Publication No. H11-244210 discloses a cleaning head whose bottom face is convexly curved, as viewed from the side, to project toward the floor surface midway between the front and rear ends of the bottom face. Japanese Unexamined Patent Publication No. 2004-33530 discloses a cleaning head whose bottom face is convexly curved, as viewed from the side (in the same manner as disclosed in Patent Publication H11-244210), but is also recessed midway between the right and left ends as viewed from the front to diverge from the floor surface.

In the cleaning devices disclosed in the above-identified Patent Publications, a shaft-like handle is connected to the cleaning head midway between the front and rear ends. When the cleaning head is slid forward on the floor surface by holding the handle, therefore, the front end of the cleaning head is pressed against the floor surface with a force exerted by the handle.

Since the cleaning heads disclosed in the above-identified Patent Publications have a bottom face which projects toward the floor surface midway between the front and rear ends and which diverges from the floor surface toward the front and rear ends, when the cleaning head is moved forward with the handle pushed by hand, therefore, the cleaning head tends to be inclined forward and pressed against the floor surface in an unstable position, which results in inefficient transmission of the force pushing the handle to the cleaning head and also results in increasing the resistance to sliding of the cleaning head along the floor surface.

If the cleaning head slides on the floor surface in a forwardly inclined position, the dirt or dust tends to attach to the cleaning sheet around the front end of the cleaning head, while the cleaning sheet remains unexploited around the rear end of the cleaning head.

In the cleaning head disclosed in Patent Publication No. 2004-33530, however, the dirt or dust can be relatively easily directed to the center of the bottom face because a recess is formed in the bottom face midway between the right and left ends. In addition, since the contact area between the cleaning head and the floor surface can be substantially decreased, the friction against the floor surface can also be decreased.

However, since the recess is formed in the bottom face to extend continuously from the front edge to the rear edge, the dirt or dust cannot be sufficiently collected by the cleaning sheet beneath the recess.

SUMMARY OF THE INVENTION

The present invention has been developed to solve the problems in the prior art set forth above and has an object to provide a cleaning device which enables efficient transmission of a pushing force from a handle to a cleaning head, smooth sliding of the cleaning head on a surface to be cleaned, and efficient exploitation of a cleaning sheet attached to the cleaning head for effective removal of dirt or dust.

According to the invention, there is provided a cleaning device comprising a cleaning head whose bottom face functions as a cleaning part and a handle connected to a top face of the cleaning head, the cleaning device being intended to be used with a cleaning sheet laid on the cleaning part, the cleaning part of the cleaning head being longer in a longitudinal direction than in a transverse direction perpendicular to the longitudinal direction and having a front edge facing forward, a rear edge facing rearward, and two side edges lying opposite to each other in the transverse direction, wherein the cleaning part has a recess extending rearward from the front edge, side contact parts on both sides of the recess in the transverse direction, and a rear contact part behind the recess, the side contact parts and the rear contact part being flush or substantially flush with each other.

According to one embodiment of the present invention, a connection between the cleaning head and the handle may be located above the rear contact part or above the recess.

When the cleaning head of the cleaning device according to the present invention is slid on a surface to be cleaned such as a floor surface by pushing the handle, not only the side contact parts but also the rear contact part flush or substantially flush with the side contact parts presses the cleaning sheet against the surface to be cleaned, which stabilizes the cleaning head during cleaning operation. Moreover, since the contact area between the cleaning head (through the cleaning sheet) and the surface to be cleaned is decreased because of the presence of the recess in front of the rear contact part, the resistance to sliding of the cleaning head along the surface to be cleaned can also be decreased. Furthermore, since the dirt or dust is directed to the center of the cleaning part through the recess formed in the cleaning head, the cleaning sheet can be efficiently exploited.

Preferably, the side contact parts and the rear contact part are continuous with each other so as to make the cleaning head more stable.

Also preferably, the recess becomes shallower toward the rear contact part so as to reduce the frictional resistance between a front end of the rear contact part and the surface to be cleaned.

Also preferably, the recess becomes shallower toward the side contact parts. If the recess becomes shallower toward the rear contact part and/or the side contact parts, the cleaning sheet can be exploited more efficiently.

According to one embodiment of the present invention, the cleaning head may have a rigid holder to which the handle is connected and a flexible pad secured beneath the holder and providing the cleaning part.

The cleaning sheet to be attached to the cleaning head may include an absorbent body for absorbing and retaining liquid, because even if the cleaning sheet is wetted with water, the recess can sufficiently reduce the frictional resistance between the cleaning sheet and the surface to be cleaned.

According to the present invention, as has been described above, the cleaning head can be stabilized on the surface to be cleaned and smoothly slid on the surface to be cleaned. In addition, the cleaning sheet can be efficiently exploited for removal of dirt or dust.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
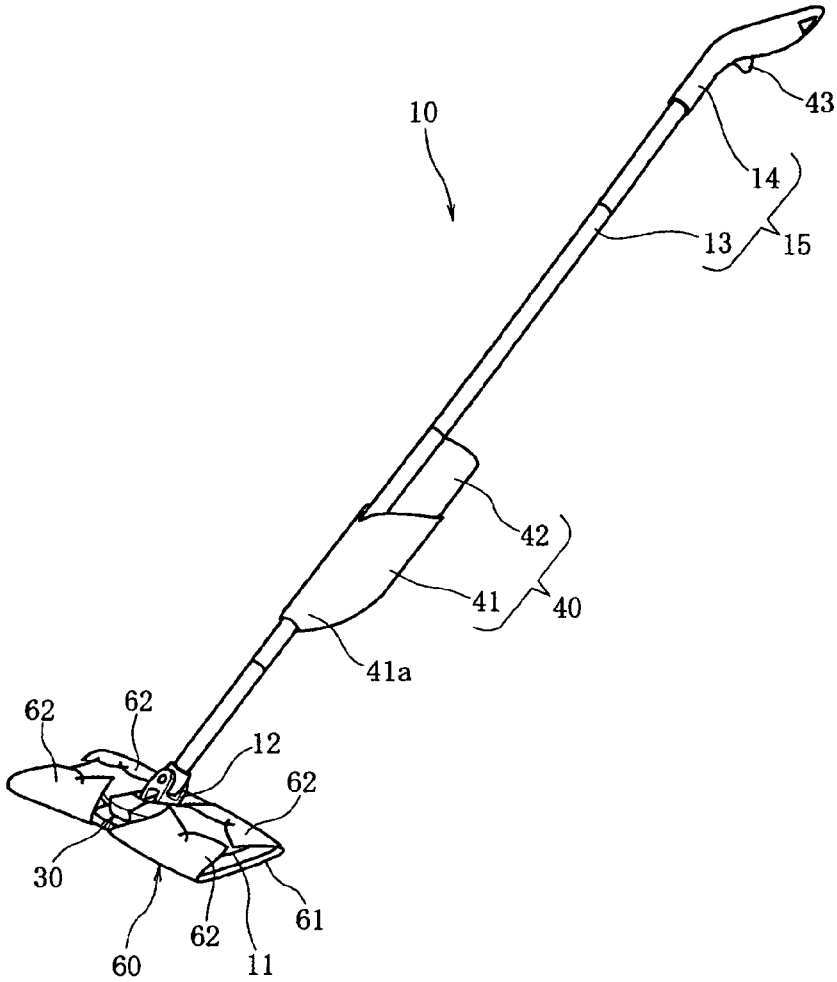
FIG. 1 is a perspective view of a cleaning device according to one embodiment of the present invention.
Figure 2:
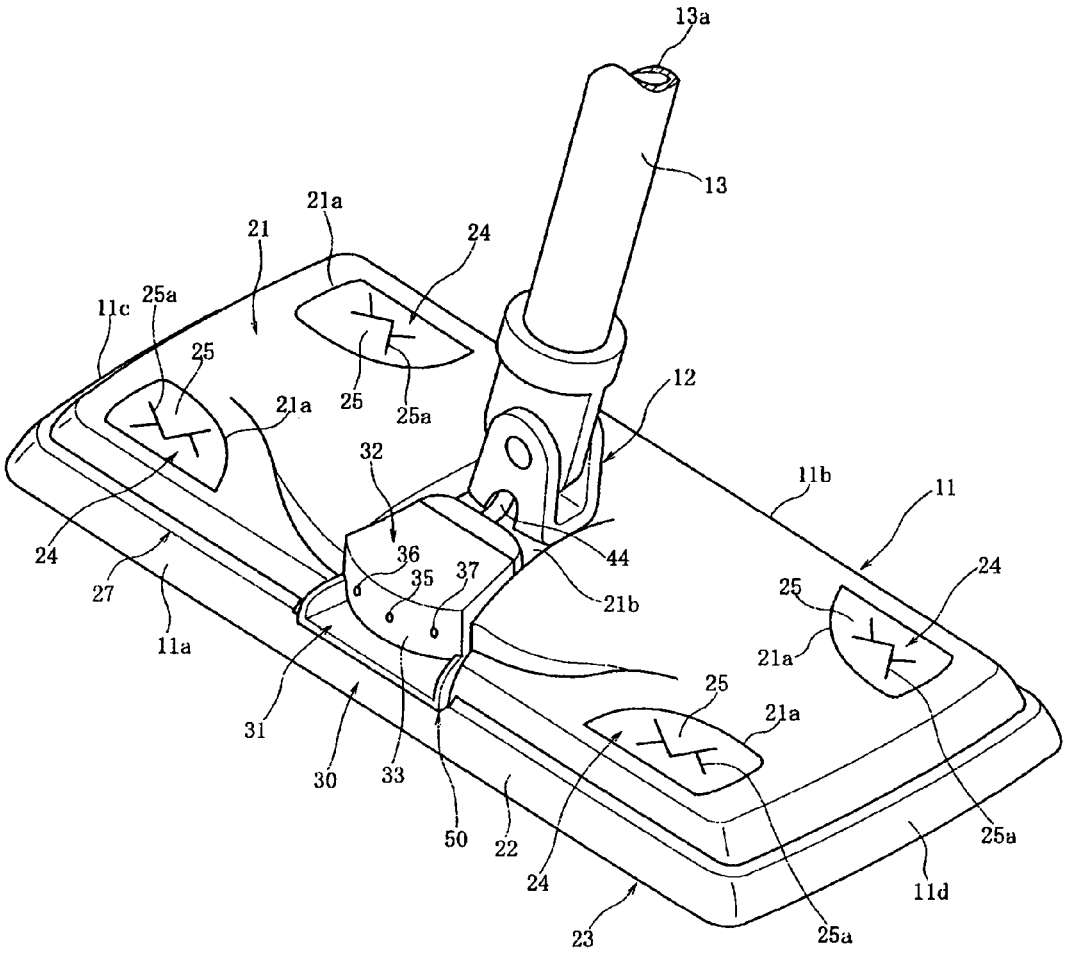
FIG. 2 is an enlarged perspective view showing a cleaning head of a cleaning device according to an embodiment of the invention.
Figure 3:
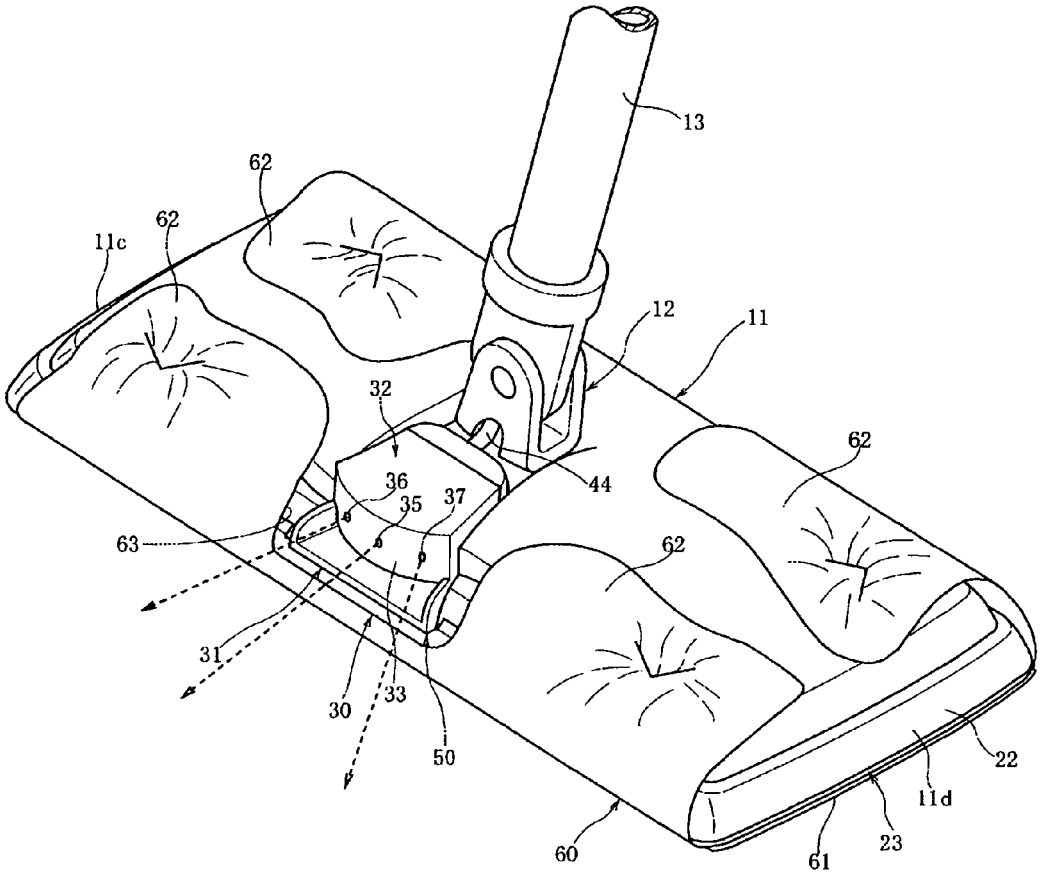
FIG. 3 is a perspective view showing a state where a disposable cleaning sheet is removably attached to the cleaning head shown in FIG. 2.
Figure 4:
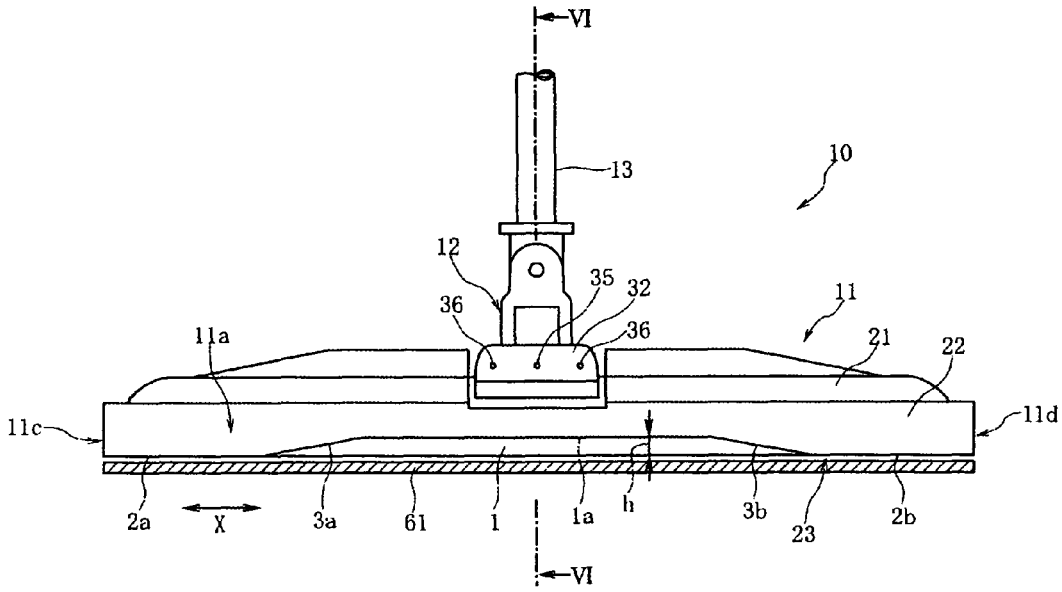
FIG. 4 is a front view of the cleaning head of FIG. 2.
Figure 5:
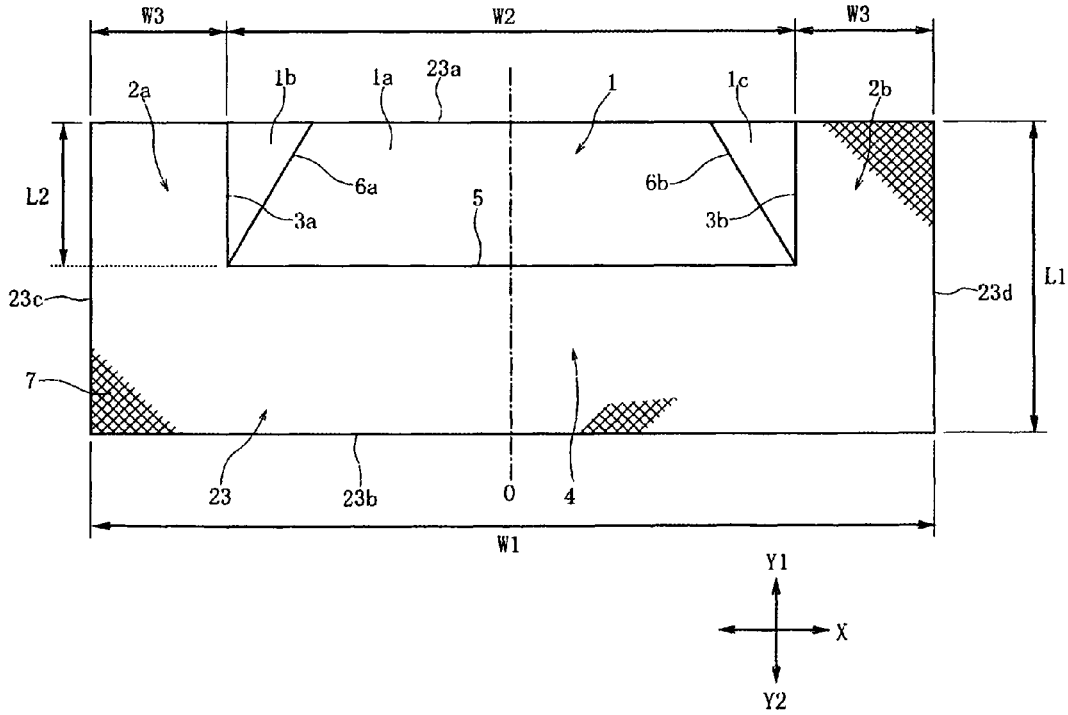
FIG. 5 is a bottom view of the cleaning head of FIG. 2, showing a cleaning part without a cleaning sheet.
Figure 6:
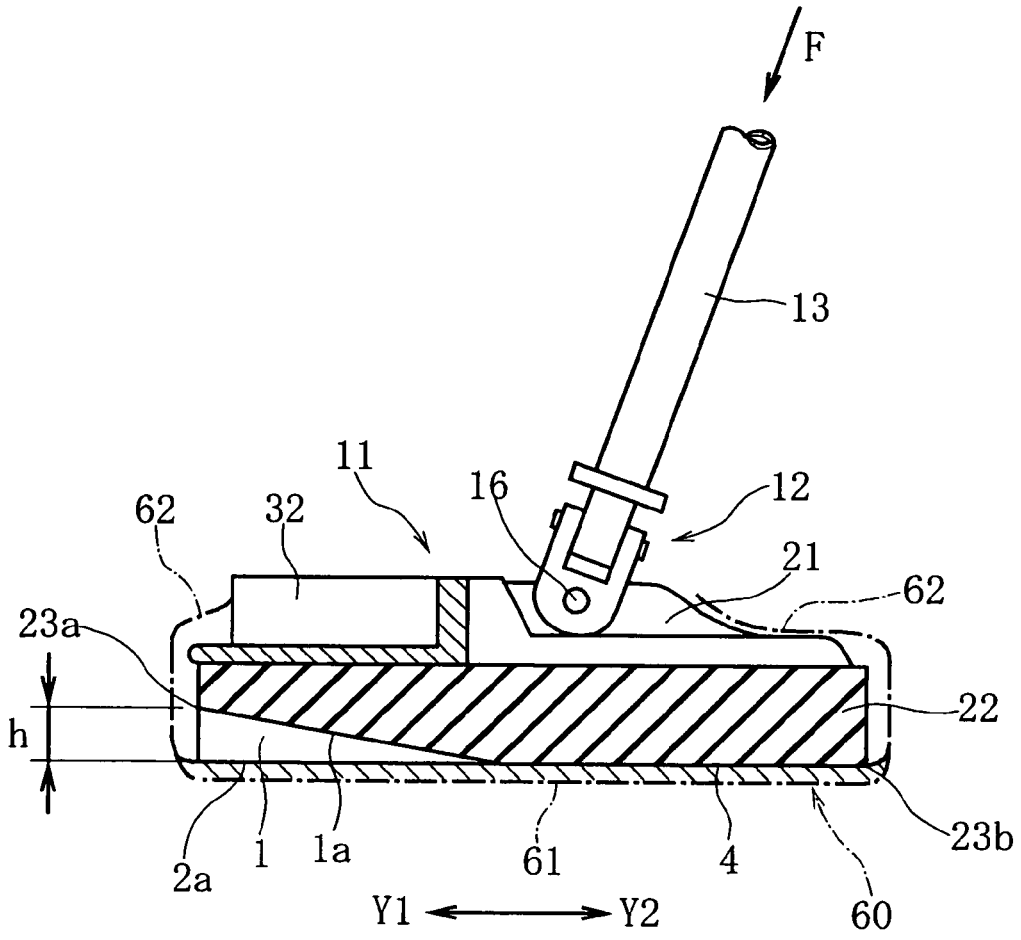
FIG. 6 is a sectional view taken along line VI-VI of FIG. 4.

FIG. 1 is a perspective view of a cleaning device 10 according to one embodiment of the present invention; FIG. 2 is an enlarged perspective view showing a cleaning head of the cleaning device 10; FIG. 3 is a perspective view showing a state where a disposable cleaning sheet is removably attached to the cleaning head; FIG. 4 is a front view of the cleaning head; FIG. 5 is a bottom view of the cleaning head showing a cleaning part without a cleaning sheet; and FIG. 6 is a sectional view taken along line VI-VI of FIG. 4.

As shown in FIG. 1, the cleaning device 10 comprises a cleaning head 11, a shaft 13 connected to the top face of the cleaning head 11 through a universal joint 12, and a grip 14 secured on the top end of the shaft 13. In the present embodiment, the shaft 13 and the grip 14 constitute a handle 15.

As viewed from above (FIG. 2), the cleaning head 11 has a generally rectangular contour. The cleaning head 11 has a front face 11*a* along one longer side of the rectangle and a rear face 11*b* along the other longer side. Moreover, the cleaning head 11 has a right end face 11*c* along one shorter side and a left end face 11*d* along the other shorter side.

The cleaning head 11 is preferably constructed of a rigid holder 21 injection molded of a synthetic resin, such as acrylonitrile-butadiene-styrene (ABS), polyethylene (PE), polypropylene (PP), polyethylene terephthalate (PET), etc., and a pad 22 secured beneath the holder 21. The pad 22 is preferably formed of a flexible elastic material such as ethylene-vinyl acetate (EVA), a resin foam such as urethane, or rubber. Alternatively, the pad 22 may be formed of soft PP or PE. The pad 22 and the holder 21 are preferably bonded and secured together.

The bottom face of the pad 22 is referred to as cleaning part 23. As shown in FIG. 5, the cleaning part 23 has a length L1 in a direction Y from front to rear (hereinafter called the "longitudinal direction") and a width W1 in a direction X from side to side (hereinafter called the "transverse direction"). The width W1 is larger than the length L1, and in the present embodiment, the cleaning part 23 is rectangular. The dimensions are not particularly limited as long as the cleaning part 23 can be suitably used for wiping a floor surface or the like with a cleaning sheet 60 attached thereto, but for instance, the length L1 may be about 60 to 160 mm and the width W1 may be about 200 to 320 mm.

The cleaning part 23 has a front edge 23*a*, a rear edge 23*b*, a right side edge 23*c* and a left side edge 23*d*. The front edge 23*a*, the rear edge 23*b*, the right side edge 23*c* and the left side edge 23*d* are also lower edges of the front face 11*a*, the rear face 11*b*, the right end face 11*c* and the left end face 11*d*, respectively. Of the direction Y, Y1 indicates the front to which the front edge 23*a* is directed and Y2 indicates the rear to which the rear edge 23*b* is directed. The cleaning part 23 is symmetrical about a centerline O extending in the longitudinal direction.

Referring to FIG. 4, the cleaning part 23 has a recess 1 extending from the front edge 23*a* toward the rear Y2. The recess 1 has a length L2 in the longitudinal direction. On both sides of the recess 1, the cleaning part 23 has side contact parts 2*a*, 2*b* (see FIG. 5). The boundary between the recess 1 and the side contact part 2*a* is indicated by 3*a*, while the boundary between the recess 1 and the side contact part 2*b* is indicated by 3*b*. Behind the recess 1 and the side contact parts 2*a*, 2*b*, the cleaning part 23 has a rear contact part 4. The boundary between the recess 1 and the rear contact part 4 is indicated by 5.

In the present embodiment, the side contact parts 2*a*, 2*b* and the rear contact part 4 are continuous with each other, and therefore, no clear distinction is drawn between the side contact parts 2*a*, 2*b* and the rear contact part 4 in FIG. 5. However, it should be noted that the side contact parts 2*a*, 2*b* are sections having the same length L2 as the recess 1 and a width W3 and the rear contact part 4 is a section having a length (L1-L2) and the width W1.

When the cleaning part 23 is applied to a level surface such as a floor surface, the side contact parts 2*a*, 2*b* and the rear contact part 4 are brought into contact with the level surface to stabilize the cleaning head 11. If desired, the side contact parts 2*a*, 2*b* and the rear contact part 4 may be smooth and flush with each other, but in the embodiment shown in FIG. 5, the side contact parts 2*a*, 2*b* and the rear contact part 4 are substantially flush with each other because a large number of small projections 7 are distributed over each contact part. The small projections 7 are provided such that a large number of grooves crossing each other are formed in each contact part to have square projections defined by the grooves. Here, the projections 7 are also distributed over the part forming the recess 1.

Alternatively, the side contact parts 2*a*, 2*b* and the rear contact part 4 may be formed by arranging a large number of tall projections or may be corrugated to alternate between ridges and grooves. In any event, the side contact parts 2*a*, 2*b* and the rear contact part 4 are flush or substantially flush with each other, and when the cleaning part 23 is applied to the level surface, the cleaning head 11 can rest still with the side contact parts 2*a*, 2*b* and the rear contact part 4 in contact with the level surface.

In the recess 1, the cleaning part 23 preferably has a main slope 1*a* and side slopes 1*b*, 1*c* on both sides of the main slope 1*a*. The main slope 1*a* is generally flat and inclined such that the depth of the recess 1 gradually decreases from the front edge 23*a* to the rear contact part 4, as shown in FIG. 6.

The boundary between the main slope 1*a* and the side slope 1*b* is indicated by 6*a*, and the boundary between the main slope 1*a* and the side slope 1*c* is indicated by 6*b*. The side slope 1*b* is generally flat and inclined such that the depth of the recess 1 gradually decreases from the boundary 6*a* to the side contact part 2*a*. The side slope 1*c* is generally flat and inclined such that the depth of the recess 1 gradually decreases from the boundary 6*b* to the side contact part 2*b*.

The individual boundaries 6*a*, 6*b* extend linearly such that the distance between the boundaries 6*a*, 6*b* gradually increases rearward.

The length L2 of the recess 1 is preferably in the range of ¼ to ¾, more preferably in the range of ¼ to ½, of the length L1 of the cleaning head 11. The width W2 of the recess 1 is preferably ½ or more of the width W1, while the width W3 of the side contact parts 2*a*, 2*b* is preferably ⅛ or more of the width W1.

Within the above ranges, the cleaning sheet 60, which is directly pressed against the floor surface or the like by the side contact parts 2*a*, 2*b* and the rear contact part 4, may be able to collect the dirt or dust more effectively and may have an adequate sliding resistance to the floor surface or the like.

At the front edge 23*a*, the recess 1 has a depth h which is preferably equal to or smaller than a thickness of a main body 61 of the cleaning sheet 60 which is to be laid on the cleaning part 23. If the depth h of the recess 1 is equal to or smaller than the thickness of the main body 61, when the cleaning head 1 is pressed against the floor surface or the like, the main body 61 beneath the main slope 1*a* of the recess 1 may also come into contact with the floor surface to remove the dirt or dust.

Here, since the pad 22 is made of a flexible material, the recess 1 may be deformed to decrease the depth h by pressing the cleaning head 11 against the floor surface. Therefore, the depth h may be equal to or less than the sum of the thickness of the main body 61 and 5 mm, preferably equal to or less than the sum of the thickness of the main body 61 and 2 mm. Also preferably the depth h is equal to or more than 1 mm.

To the top face of the holder 21, the universal joint 12 is connected at the midpoint between the right end face 11*c* and the left end face 11*d*. As shown in FIG. 6, the universal joint 12 may be connected to the holder 21 through a shaft 16. The part where the shaft 16 is provided, i.e., the connection between the handle 15 and the holder 21, lies on the centerline O and is located above the rear contact part 4. Alternatively, the connection may be located above the recess 1.

If the connection is located above the rear contact part 4 or above the recess 1, when a pushing force F is forwardly and downwardly applied to the cleaning head 11 from the handle 15, the cleaning head 11 can be stabilized during cleaning with the side contact parts 2*a*, 2*b* being pressed against the floor surface or the like.

In the top face, the holder 21 has sheet retainers 24 inside four corners of the rectangle, i.e., the corner between the front face 11*a* and the right end face 11*c*, the corner between the front face 11*a* and the left end face 11*d*, the corner between the rear face 11*b* and the right end face 11*c*, and the corner between the rear face 11*b* and the left end face 11*d*. The sheet retainer 24 is preferably constructed by forming an opening 21*a* in the top face of the holder 21 and covering the opening 21*a* with a deformable sheet 25 made of PE, PP, PET, etc. The deformable sheet 25 has a cut 25*a*. FIG. 3 shows a state where the cleaning sheet 60 is retained on the cleaning head 11 such that parts of the cleaning sheet 60 are pushed into the cuts 25*a*.

As shown in FIG. 2, a liquid jetting part 30 is mounted on the holder 21. The liquid jetting part 30 is preferably located at the midpoint between the right end face 11*c* and the left end face 11*d* of the holder 21 and in front of the universal joint 12. The liquid jetting part 30 may be constructed of two components: a base 31 and a nozzle head 32. The nozzle head 32 has a front face (squirt surface) 33 where three nozzles 35, 36, 37 have orifices.

As shown in FIG. 1, the shaft 13 is provided with a container holder 41 for holding a container 42 filled with a liquid. In the embodiment of FIG. 1, the container holder 41 and the container 42 constitute a liquid retention part 40. Inside a lower part 41*a* of the container holder 41, there is provided an interrupting mechanism with a valve. The grip 14 is provided with an operating part 43 so that the valve of the interrupting mechanism can be opened by pressing the operating part 43.

When the valve is opened, liquid inside the container 42 passes through a hollow 13*a* of the shaft 13 and then through a pipe 44 under force of gravity to reach the nozzle head 32. In the embodiment of FIG. 6, the hollow 13*a* and the pipe 44 constitute a liquid passage. Moreover, the liquid passage and the liquid retention part 40 constitute a liquid supply part.

Hereinbelow, how to use the cleaning device 10 will be described.

FIG. 3 shows a state where the disposable cleaning sheet 60 is attached to the cleaning head 11. The cleaning sheet 60 has the main body 61 which is to be laid on the cleaning part 23 (the bottom face of the pad 22). In the main body 61, a nonwoven fabric is situated on one side to face the surface to be cleaned, and behind the nonwoven fabric, an absorbent layer is disposed to absorb and retain liquid. Attachment sheets 62, 62 are integrally formed to extend forward and rearward from the main body 61 of the cleaning sheet 60. The cleaning sheet 60 may be attached to the cleaning head 11 by folding back the attachment sheets 62, 62 upon the top face of the holder 21 to cover the front face 11*a* and the rear face 11*b* of the cleaning head 11 and then tucking the attachment sheets 62, 62 into the sheet retainers 24.

The attachment sheet 62 covering the front face 11*a* of the cleaning head 11 has an indentation 63 through which the squirting surface 33 of the nozzle head 32 can be exposed externally.

When using the cleaning device 10, as shown in FIGS. 1 and 6, the main body 61 of the cleaning sheet 60, which is laid on the cleaning part 23 of the cleaning head 11, is applied to the floor surface or the like. By pressing the operating part 43 with the grip 14 being held by hand, the valve of the interrupting mechanism provided in the lower part 41*a* of the container holder 41 can be opened to permit the space above the liquid within the container 42 to communicate with the atmosphere. As a result, the liquid pressure within the nozzle head 32 is increased through the liquid passage in accordance with the liquid level within the container 42, and the liquid is squirted forward from the nozzles 35, 36, 37 and applied to the floor surface in front of the cleaning head 11. After the floor surface is wetted with the liquid, the cleaning head 11 is moved forward to wipe the floor with the cleaning sheet 60.

The liquid in the container 42 may be plain water, or may contain a detergent for cleansing a floor surface, a high gloss wax, etc.

When the cleaning head 11 is moved forward (to the front Y1) by holding and pushing forward the grip 14, the front portion of the cleaning head 11 is pressed against the floor surface by the pushing force F acting axially of the shaft 13 as shown in FIG. 6.

The pushing force F is exerted on the cleaning head 11 mainly in front of the universal joint 12 to push hard the transverse center of the front portion of the cleaning head 11 to the floor surface. In front of the universal joint 12, however, the cleaning head 11 is formed with the main slope 1*a*, which is inclined forward to gradually separate from the floor surface. Accordingly, the cleaning sheet 60 beneath the recess 1 is prevented from being given an excessive pushing force. Here, the pushing force F has components which act on the side contact parts 2*a*, 2*b* to press the cleaning sheet 60 against the floor surface, but since the side contact parts 2*a*, 2*b* are separated far enough, the components of the pushing force F are prevented from being extremely large. Therefore, the cleaning part 23 will not exert too much pressure on the cleaning sheet 60 and will not provide a large frictional resistance when the cleaning head 11 is moved forward along the floor surface.

When a liquid is applied to the floor surface and the main body 61 of the cleaning sheet 60 is wetted with the liquid absorbed therein, the coefficient of friction between the cleaning sheet 60 and the floor surface may increase. However, since the front portion of the cleaning head 11 is prevented from being extremely strongly pressed against the floor surface, even if the main body 61 is wetted, the cleaning sheet 60 can slide smoothly on the floor surface.

Since the cleaning sheet 60 beneath the recess 1 will not be strongly pressed against the floor surface, relatively large dust or litter can be attached to the cleaning sheet 60 beneath the recess 1. On the other hand, relatively small dust may pass beneath the recess 1 and be then attached to the cleaning sheet 60 by the pressure from the rear contact part 4. Here, the cleaning liquid squirted from the nozzles 35, 36, 37 to the floor surface can also pass beneath the recess 1 and spread widely between the cleaning sheet 60 and the floor surface, without being blocked or pushed aside by the front face 11*a* of the cleaning head 11. Therefore, the liquid can be easily absorbed by the main body 61 of the cleaning sheet 60. This prevents the floor surface from remaining wet with the liquid, or furniture from being wetted with the cleaning liquid.

With the cleaning part 23, as has been described hereinabove, the cleaning sheet 60 can be efficiently exploited for removal of dirt or dust. That is, the cleaning part 23 can extend the service life of the cleaning sheet 60 by preventing the cleaning sheet 60 from being partially soiled in a short period of time. Particularly when the main slope 1*a* of the recess 1 is inclined forward to gradually separate from the floor surface and the depth h at the front end of the recess 1 is equal to or smaller than the thickness of the main body 61 of the cleaning sheet 60 or slightly larger than the thickness, the cleaning sheet 60 beneath the main slope 1*a* can be gently pressed against the floor surface and also contribute to cleaning.

In the foregoing embodiment, the nozzles 35, 36, 37 are designed to squirt liquid out of the cleaning head 11, but the nozzles 35, 36, 37 are not limited thereto and may be designed to apply liquid to the upper side of the cleaning sheet 60 for wetting the cleaning sheet 60. In an alternative, the nozzles may be omitted and liquid may be applied to the cleaning sheet 60 by means independent of the cleaning device. In another alternative, the cleaning sheet 60 may be used without being wetted with the liquid. Even in this case, the cleaning part 23 is effective in decreasing the frictional resistance during cleaning and in exploiting the cleaning sheet for removal of dirt or dust.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but should be understood to include all possible embodiments which can be embodied within a scope encompassed and equivalent thereof with respect to the feature set out in the appended claims.

What is claimed is:

1. A cleaning device comprising a cleaning head whose bottom face functions as a cleaning part and a handle connected to a top face of the cleaning head, the cleaning device to be used with a cleaning sheet laid on the cleaning part, the bottom face of the cleaning head being longer in a longitudinal direction than in a transverse direction perpendicular to the longitudinal direction and having a front edge facing forward, a rear edge facing rearward, and two side edges lying opposite to each other in the longitudinal direction, wherein the bottom face of said cleaning head defines a downwardly facing recess extending rearward from the front edge, said recess being defined by a top surface, side contact surfaces, and a rear contact surface, the side contact surfaces and the rear contact surface being arranged on the bottom face of the cleaning head and being flush or substantially flush with each other, the side contact surfaces and the rear contact surface are continuous with each other, and the recess has a depth from the top surface to the rear contact surface that becomes shallower toward the side contact surfaces.

2. The cleaning device of claim 1, wherein a connection between the cleaning head and the handle is located above the rear contact surface or above the recess.

3. The cleaning device of claim 1, wherein depth of the recess becomes shallower toward the rear contact surface.

4. The cleaning device of claim 1, wherein the cleaning head has a rigid holder to which the handle is connected and a flexible pad secured beneath the holder and providing the cleaning part.

5. The cleaning device of claim 1, wherein the cleaning sheet to be attached to the cleaning head includes an absorbent body for absorbing and retaining liquid.

* * * * *